US006048098A

United States Patent [19]

Vetter

[11] Patent Number: 6,048,098

[45] Date of Patent: Apr. 11, 2000

[54] TAMPER-RESISTANT ENVELOPE

[75] Inventor: Kurt W. Vetter, Huntington, N.Y.

[73] Assignee: Uniflex, Inc., Westbury, N.Y.

[21] Appl. No.: 08/467,084

[22] Filed: Jun. 6, 1995

[51] Int. Cl.[7] ..... B65D 33/34

[52] U.S. Cl. ..... 383/5; 383/61; 383/84; 383/93

[58] Field of Search ..... 383/5, 61, 84, 383/93, 210, 211

[56] References Cited

U.S. PATENT DOCUMENTS

| | | | |
|---|---|---|---|
| 3,279,331 | 10/1966 | Platt . | |
| 4,276,982 | 7/1981 | Sibrava et al. . | |
| 4,358,015 | 11/1982 | Hirsch . | |
| 4,402,453 | 9/1983 | Regenstein, Jr. . | |
| 4,483,018 | 11/1984 | Whelan . | |
| 4,712,729 | 12/1987 | Craig | 383/5 X |
| 4,759,643 | 7/1988 | Canno | 383/84 |
| 4,834,552 | 5/1989 | Makowka . | |
| 4,874,090 | 10/1989 | Dyke . | |
| 4,937,040 | 6/1990 | Holcomb et al. . | |
| 4,941,196 | 7/1990 | Edelman et al. . | |
| 5,041,072 | 8/1991 | McClelland . | |
| 5,049,118 | 9/1991 | McNabb . | |
| 5,082,702 | 1/1992 | Alband . | |
| 5,346,301 | 9/1994 | Scarberry et al. . | |
| 5,366,087 | 11/1994 | Bane | 383/5 X |
| 5,391,136 | 2/1995 | Makowka . | |

FOREIGN PATENT DOCUMENTS

| | | | |
|---|---|---|---|
| 1025034 | 4/1966 | United Kingdom | 383/5 |
| 1365240 | 8/1974 | United Kingdom | 383/5 |
| 1470786 | 4/1977 | United Kingdom | 383/84 |
| 2066208 | 7/1981 | United Kingdom | 383/211 |
| 2120638 | 12/1983 | United Kingdom | 383/5 |
| 2265883 | 10/1993 | United Kingdom | 383/93 |

*Primary Examiner*—Jes F. Pascua
*Attorney, Agent, or Firm*—Dilworth & Barrese

[57] ABSTRACT

A tamper-resistant envelope is disclosed which includes first and second panels joined to one another to define opposed side edges and a bottom edge. The envelope has an opening opposite the bottom edge for providing access thereunto. A first adhesive seal is disposed on one of the first and second panels adjacent the opening for sealingly adhering to the other of the two panels. The first adhesive seal is formed of an adhesive material having adherent properties which are resistant to release at temperatures substantially below room temperature. A second adhesive seal is disposed on one of the first and second panels for sealingly adhering to the other of the two panels. The second adhesive seal is formed of an adhesive material having adherent properties which are different from those of the adhesive material from which the first adhesive seal is formed.

22 Claims, 8 Drawing Sheets

TAMPER-RESISTANT ENVELOPE

BACKGROUND OF THE INVENTION

1. Field of the Invention

The subject invention is directed to plastic security envelopes, and more particularly, to a tamper-resistant envelope having two different adhesive closure seals associated therewith.

2. Description of the Related Art

Plastic security envelopes are well known in the art. They are commonly utilized to transport money, checks, bonds, stocks, food stamps, medical specimens, jewelry and other items of value. These envelopes must be constructed to remain closed during transport and handling, and resist tampering such that the contents are not compromised.

One problem that has arisen with respect to the adhesive materials utilized to seal plastic security envelopes is that the seals may be covertly opened after closure by lowering the temperature of the sealed region. This can be accomplished by spraying the envelope with a freon-type material or applying dry ice to the envelope. Once opened, the contents of the envelope can be accessed or removed, and the envelope can be subsequently resealed without any evidence of tampering.

Adhesive materials having adherent properties which are resistant to, or unaffected by low temperatures are also known and have been employed on security envelopes to prevent tampering. For example, U.S. Pat. No. 4,937,040 to Holcomb et al. discloses an adhesive closure system which includes means for forming indicia therein if the envelope is opened at temperatures substantially below room temperature. To fabricate the adhesive closure system, multiple layers of adhesive material are applied to the surfaces of the envelope. This fabrication process is time consuming and costly.

The subject invention provides an improved low-cost tamper-resistant security envelope which employs two different types of adhesive seals including one which is unaffected by low temperatures.

SUMMARY OF THE INVENTION

The subject invention is directed to an improved tamper-resistant security envelope for transporting items of value. The envelope includes first and second panels which are joined to one another to define opposed side edges and a bottom edge of the envelope. An opening is defined opposite the bottom edge of the envelope for providing access thereinto. The envelope has two adhesive seals associated therewith. The first adhesive seal is positioned on one of the first and second panels adjacent the opening for sealingly adhering to the other of the two panels, and is formed of a material having adherent properties which are resistant to release at temperatures substantially below room temperature. The second adhesive seal is positioned on one of the first and second panels adjacent the first adhesive seal, for sealingly adhering to the other of the two panels, and is formed of a material having adherent properties which are different from those of the material from which the first adhesive seal is formed.

In a preferred embodiment of the subject invention, the tamper-resistant envelope includes first and second panels which are joined to one another to define opposed side edges and a bottom edge. Each of the panels has an upper edge which together define an opening opposite the bottom edge for providing access into the envelope. The upper edge of the first panel extends beyond the upper edge of second panel to define a fold-over flap. The first adhesive seal is disposed on the fold-over flap for sealingly adhering to an exterior surface of the second panel, and is formed of an adhesive material which has adherent properties that are resistant to release at temperatures substantially below room temperature. The second adhesive seal is disposed on the first panel at a location spaced from the first adhesive seal for sealingly adhering to an interior surface of the second panel, and is formed of an adhesive material having adherent properties which are different from those of the first adhesive seal.

In another preferred embodiment of the subject invention, the tamper-resistant envelope includes first and second panels which are joined to one another to define opposed side edges and a bottom edge. The envelope has an opening opposite the bottom edge for providing access into the interior thereof. The first adhesive seal is disposed on an interior surface of the first panel adjacent the opening for sealingly adhering to an interior surface of the second panel, and is formed of an adhesive material having adherent properties which are resistant to release at temperatures substantially below room temperature. The second adhesive seal is disposed on an interior surface of the first panel, spaced from the first adhesive seal, for sealingly adhering to the interior surface of the second panel, and is formed of an adhesive material having adherent properties which are different from those of the adhesive material from which the first adhesive seal is formed.

In each of the preferred embodiments of the subject invention, the envelope further includes a release liner strip which is associated with the seal region and is coextensive with the first adhesive seal and the second adhesive seal to prevent their contact with the interior surface of the second panel prior to closing the envelope. In addition, a removable flap may be operatively connected to the first panel to define a receipt. A perforation line extends across the first panel to delimit the removable flap and facilitate the removal thereof.

There is preferably indicia imprinted on the second panel in areas opposite the first and second adhesive seals which becomes affixed to the first and second adhesive seals when the envelope is closed to indicate that tampering has occurred. The envelope is preferably formed from a single piece of plastic material which is folded in such a manner so as to define the first and second panels. The first and second panels are fused to one another along the opposed side edges thereof, and may also be fused to one another at a plurality of spaced apart locations adjacent the opposed side edges.

These and other features of the subject invention will become more readily apparent to those skilled in the art from the following detailed description of the preferred embodiments of the invention taken in conjunction with the drawings.

BRIEF DESCRIPTION OF THE DRAWINGS

So that one skilled in the art to which the subject invention appertains will better understand how to make and use the invention, preferred embodiments thereof will be described hereinbelow with reference to the drawings wherein.

DETAILED DESCRIPTION OF THE PREFERRED EMBODIMENTS

Figure 1:
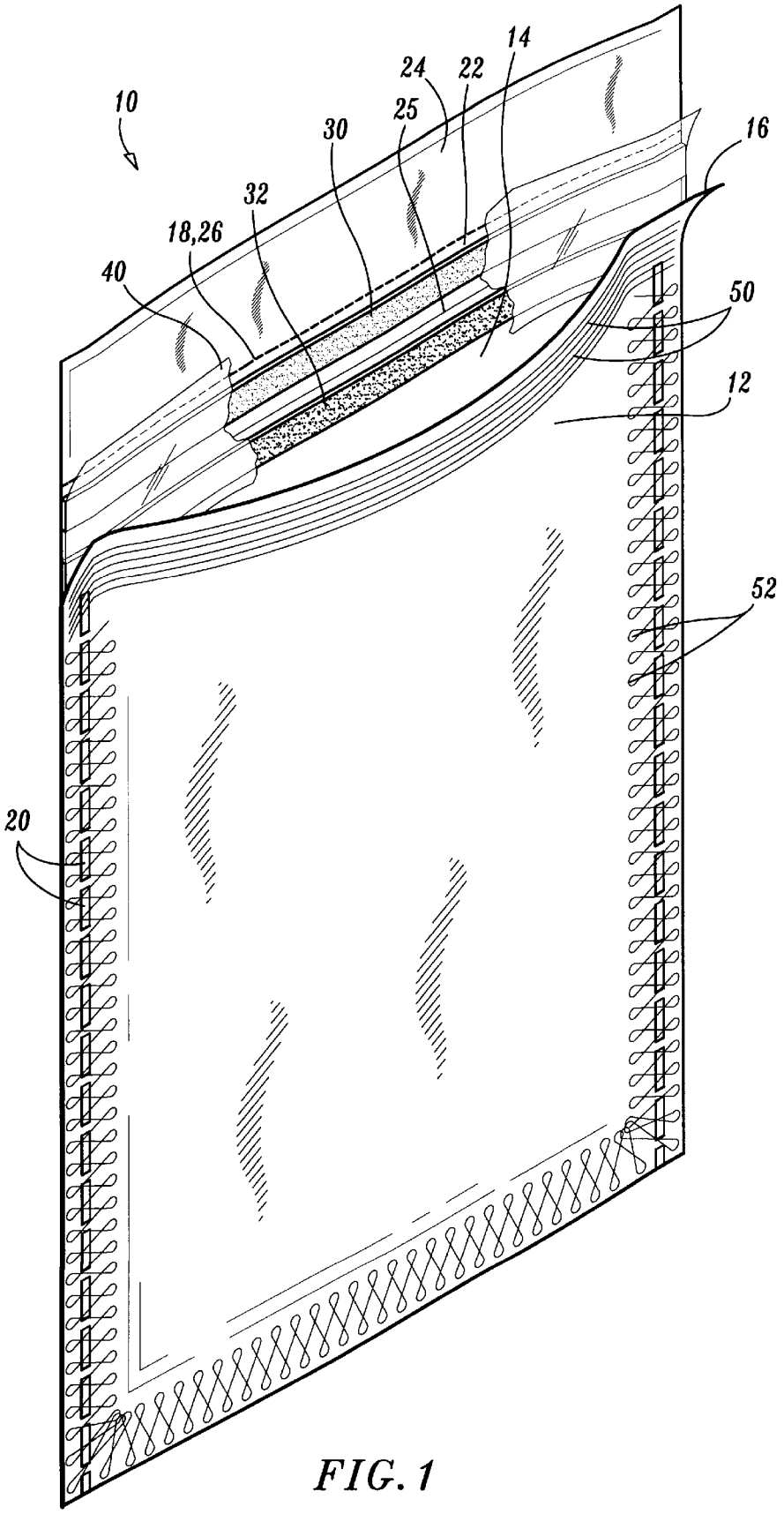
FIG. 1 is a perspective view of a tamper-resistant security envelope constructed in accordance with a preferred embodiment of the subject invention.

Referring now in detail to the drawings wherein like reference numerals identify similar structural elements of the subject invention, there is illustrated in FIG. 1 a tamper-resistant security envelope constructed in accordance with a preferred embodiment of the subject invention and designated generally by reference numeral 10. Envelope 10 is constructed with several security features including two seals which function to prevent unauthorized entry into the interior of the envelope, and several visual systems which provide evidence of tampering.

Preferably, envelope 10 is formed from a single piece of plastic material which is folded in such a manner during a forming process so as to define the front and rear panels of the envelope. Alternatively, the two panels of the envelope may be formed separately from one another and subsequently joined together by fusing the respective side and bottom edges thereof. The material from which envelope 10 is constructed is preferably a light-weight durable plastic such as polyethylene, polypropylene, polyethylene terephthalate, polyvinylchloride, vinyl acetate, or other similar plastic material. A material thickness of about 0.0002 inches or heavier is typical for security envelopes. The envelope material may be a single layer or multiple layers, and may be opaque, translucent or transparent.

Referring now to FIG. 1, envelope 10 includes two panels, a front panel 12 and a rear panel 14. The upper edge 16 of front 12 and the upper edge 18 of rear panel 14 define an opening for gaining access into the interior of the envelope. The front and rear panels of the envelope are joined to one another along the respective side and bottom edges thereof by heat welding or fusing methods which are well known in the art. The fused regions extend from the bottom edge of the envelope and terminate at a location slightly below the upper edge 16 of front panel 12 to further define the opening of the envelope. The terminated fused regions may extend to a location slightly below the seal region of the envelope to define air outlets when the envelope is sealed.

It is known that plastic security envelopes can be infiltrated by cutting open or slicing the fused side edges of the envelope, removing the contents thereof, and subsequently resealing the edges with heat sealing means. To prevent such intrusions, a skip seal is provided adjacent each of the opposed side edges of the envelope. Skip seals, which consist of a plurality of linearly spaced apart heat fused areas 20 that extend parallel to the fused edges of the envelope, are difficult to reseal by heating without presenting visual evidence of tampering.

Figure 2:
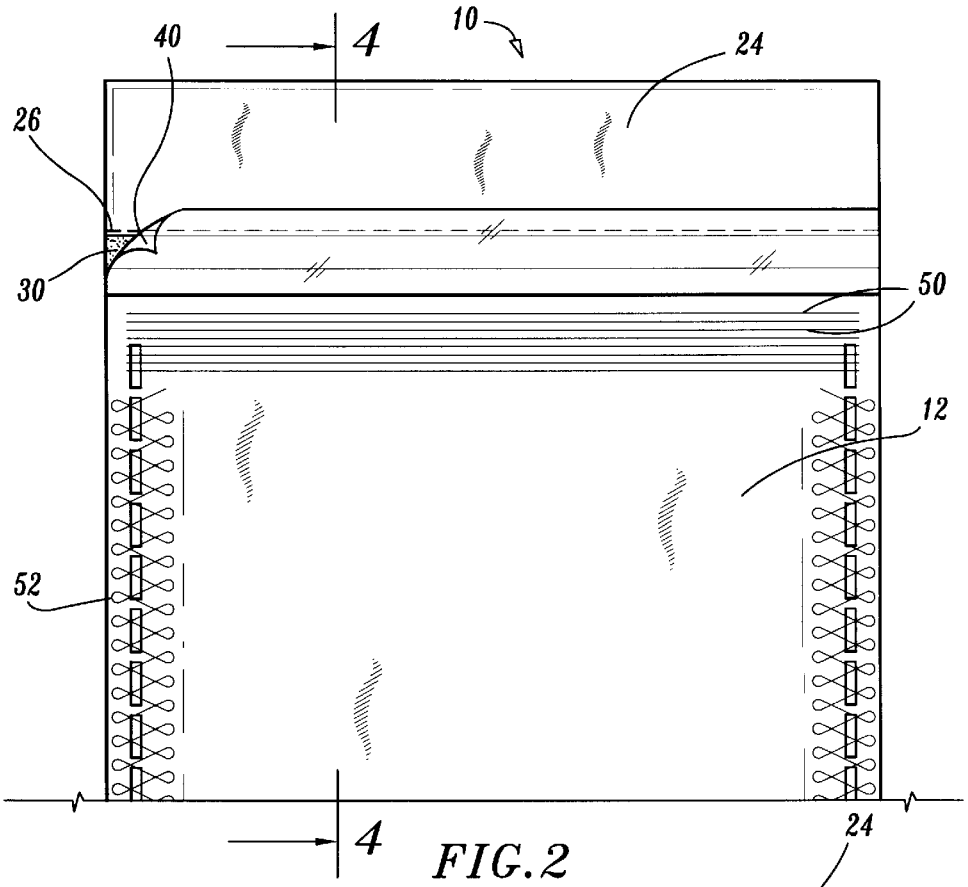
FIG. 2 is a front elevational view of the tamper-resistant envelope illustrated in FIG. 1 with the release liner strip positioned between the upper edges of the front and rear panels of the envelope.
Figure 7:
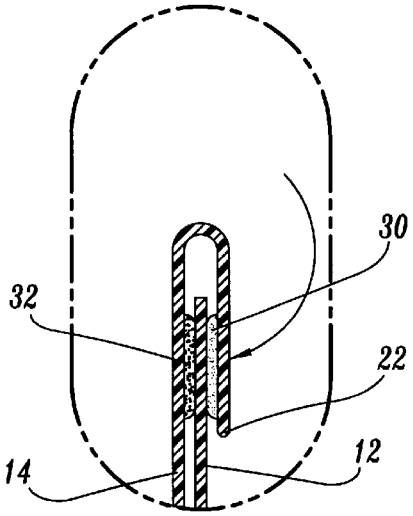
FIG. 7 is a localized view as in FIG. 6 illustrating the envelope in a sealed condition with the first adhesive seal secured to the exterior surface of the front panel and the second adhesive seal secured to the interior surface of the front panel of the envelope.

Referring to FIG. 1 in conjunction with FIG. 7, the upper edge 18 of rear panel 14 extends beyond the upper edge 16 of front panel 12 to define a fold-over portion 22 delimited by a fold line 25. A flap section 24 is operatively connected to fold-over portion 22 by a perforation line 26 which delimits the upper edge 18 of rear panel 14. The flap section 24, which is approximately 1¾" wide, defines a receipt which may be removed from the envelope by tearing along perforation line 26, and retained by the sender for tracking purposes. As shown in FIG. 2, corresponding numerical indicia 28*a* and 28*b* is imprinted on flap section 24 and on the exterior surface of rear panel 14, respectively, to identify the envelope. It is envisioned that the indicia could alternatively be in the form of graphics, holographic images, or bar codes.

Figure 5:
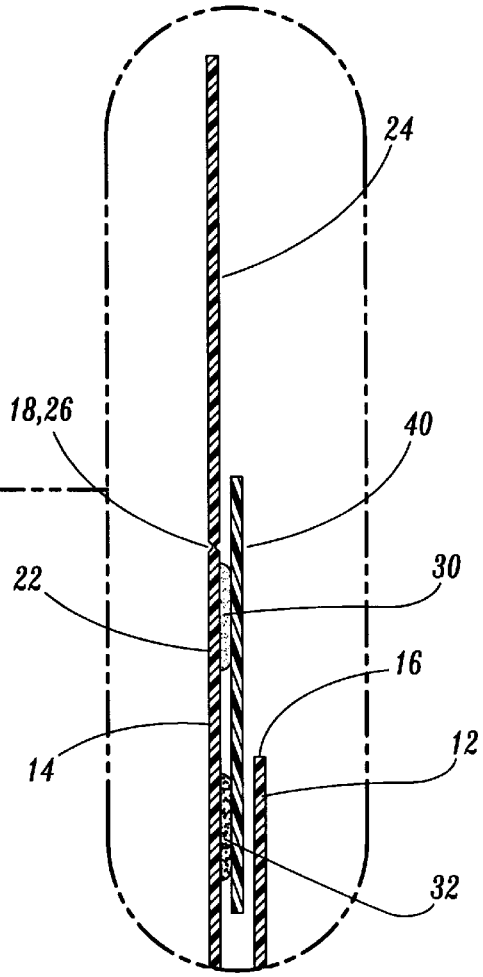
FIG. 5 is an enlarged localized view of the upper region of the tamper-resistant envelope illustrated in FIG. 1 with the release liner strip covering the first and second adhesive seals to prevent their contact with the front panel prior to closing the envelope.

Referring to FIG. 1 in conjunction with FIG. 5, security envelope 10 includes two adhesive seals for securely sealing the opening of the envelope. The first adhesive seal 30 consist of a layer of pressure sensitive adhesive sealant material which is applied to the interior surface of rear panel 14 between upper edge 18 (perforation line 26) and fold-line 25, and is positioned to sealingly adhere to the exterior surface of front panel 12. Seal 30 defines a linear seal which extends across the entire width of the rear panel. In a preferred embodiment of the subject invention, seal 30 is approximately ⅜ wide and the centerline of the seal is located approximately 2.0" from the upper-most edge of flap section 24.

Preferably, the sealant material from which seal 30 is formed has adherent properties which are resistant to release at temperatures substantially below room temperature, or the application of freezing agents such as dry ice and freon spray. Such adhesive materials may be derived from acrylic, natural rubber, polyisobutylene, silicone, or other similar materials having the desired adherent properties. An extremely desirable adhesive material having such properties is available under the trade-name National 70-8615.

With continued reference to FIG. 1, the second adhesive seal 32 is disposed on the interior surface of rear panel 14 and is positioned below fold line 25 to sealingly adhere to the interior surface of front panel 12 when envelope 10 is sealed. Adhesive seal 32 extends across the entire width of the rear panel a small distance above the point of termination of the fused side edges of the envelope. In a preferred embodiment of the subject invention, adhesive seal 32 is approximately ⅜" wide and the centerline of the seal is approximately ¼" below the upper edge 16 of front panel 12.

The adhesive material from which seal 32 is formed has different adherent properties than the adhesive material from which seal 30 is formed. More particularly, the adhesive material of seal 32 is not particularly resistant to temperatures substantially below room temperature. Preferably, the material is a standard hot melt pressure sensitive adhesive. One such adhesive material is commercially available from H. B. Fuller, 59 Brunswick Avenue, Edison, N.J., and is marketed under the tradename HL 2201.

Referring to FIGS. 1 and 2, security envelope 10 also includes a protective release liner 40 which is formed of a strip of low adhesion plastic material suitable for use with the particular adhesive materials employed on the envelope. Release liner 40 is dimensioned and configured to cover adhesive seals 30 and 32 in there entireties to prevent the two adhesive seals from contacting front panel 12 before the envelope is closed, i.e., during packing, storing, and handling. When the envelope is employed, release liner 40 is easily removable. Moreover, release liner 40 is preferably dimensioned to extend beyond the upper limits of adhesive seal 30, and beyond the lower limits of adhesive seal 32 to provide the user with a means for grasping the release liner during removal. The release liner has an approximate width of about 1½".

Figure 3:
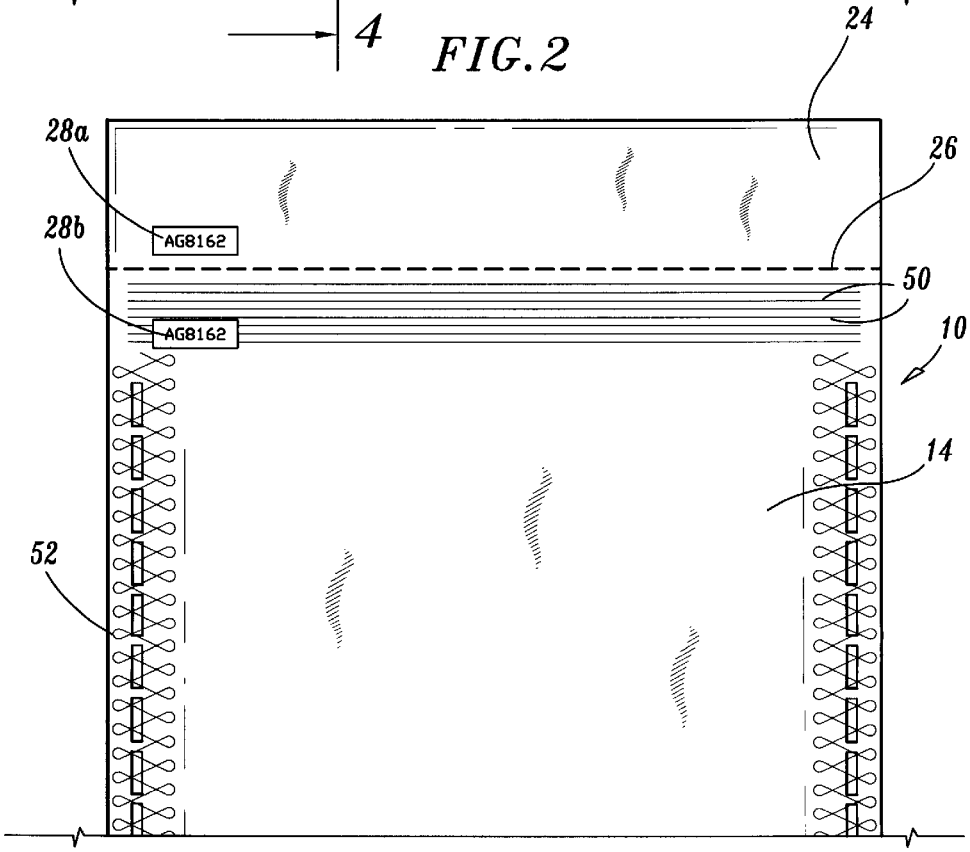
FIG. 3 is a rear elevational view of the tamper-resistant envelope illustrated in FIG. 1 with an envelope identification system shown in the form of numerical indicia imprinted on the removable receipt portion and the rear panel of the envelope.

Referring to FIGS. 2 and 3, security envelope 10 is also furnished with tamper-evident systems that provide visually observable evidence of tampering. In particular, the border regions of security envelope 10 are imprinted with geometric patterns that become distorted if attempts are made to open the envelope. The geometric patterns include a plurality of spaced apart parallel lines 50 which extend across the upper borders of both panels of envelope 10, and a swirled pattern 52 which is imprinted in the border regions adjacent the side and bottom edges of the front and rear panels of envelope 10. Any distortion of the geometric patterns will indicate to an observer that the envelope has been tampered with, and that its contents may have been compromised.

Figure 4:
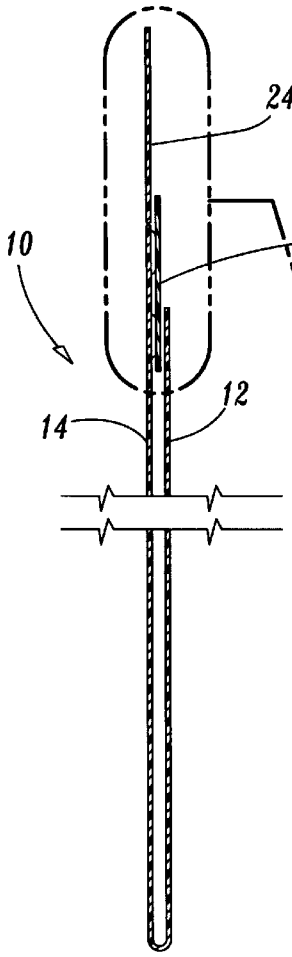
FIG. 4 is a cross-sectional view of tamper resistant envelope of the subject invention taken along line 4—4 of FIG. 2.
Figure 6:
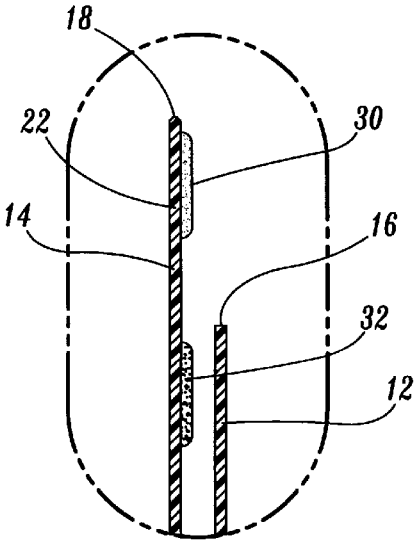
FIG. 6 is a localized view as in FIG. 5 with the release liner strip removed from the envelope to uncover the first and second adhesive seals.

Referring now in sequential order to FIGS. 4–7, to securely seal envelope 10, release liner strip 40 is removed from the protective position illustrated in FIGS. 4 and 5, and discarded. At such a time, adhesive seals 30 is free to contact the exterior surface of front panel 12 and adhesive seal 32 is free to contact the interior surface of front panel 12, as shown in FIG. 6. Subsequently, flap 22 is folded over about fold line 25 (FIG. 1), and pressure is applied to the seal region to adhere seals 30 and 32 to the exterior and interior surfaces of front panel 12, respectively, as illustrated in FIG. 7. Thereupon, envelope 10 cannot be opened by applying a cooling or freezing agent to the sealed region, since adhesive seal 30 is unaffected by such tampering. However, if such attempts are made, and force is applied to the sealed region of the envelope to gain access into the interior thereof, the parallel lines 50 imprinted adjacent the upper edges of the front and rear panels of the envelope will become distorted, as illustrated for example in FIG. 17, providing evidence of tampering.

Figure 8:
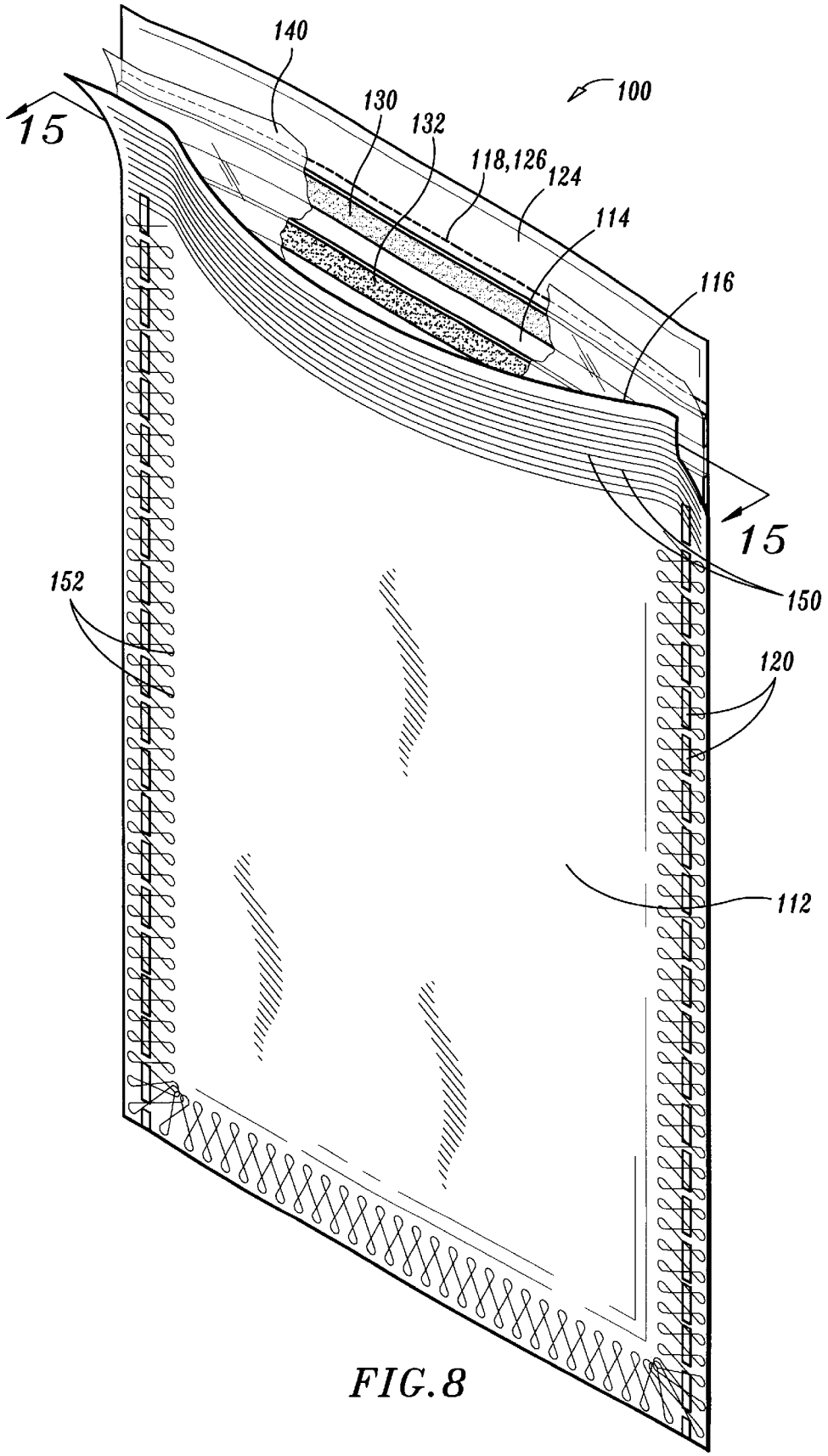
FIG. 8 is a perspective view of another tamper-resistant envelope constructed in accordance with a preferred embodiment of the subject invention.

Referring now to FIG. 8, there is illustrated another tamper-resistant security envelope constructed in accordance with a preferred embodiment of the subject invention and designated generally by reference numeral 100. Envelope 100 includes front and rear panels 112 and 114 which are joined to one another along opposed side and bottom edges. The upper edge 116 of front panel 112 and the upper edge 118 of rear panel 114 define an opening opposite the bottom of the envelope to provide access into the interior thereof.

Figure 10:
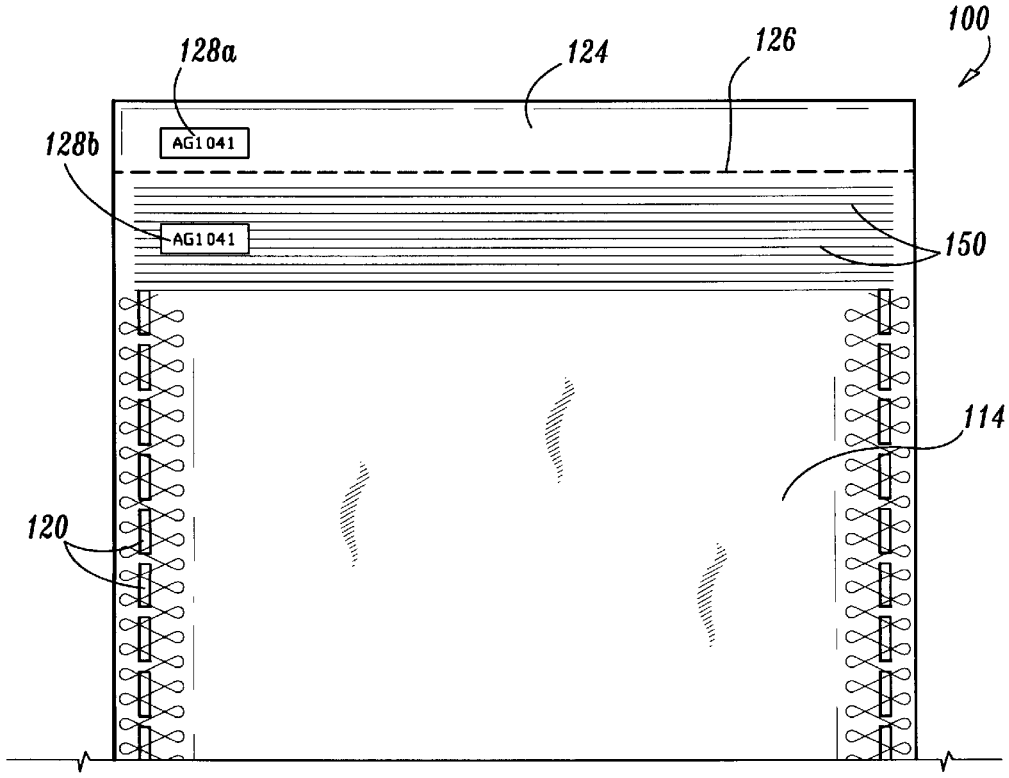
FIG. 10 is a rear elevational view of the tamper-resistant envelope illustrated in FIG. 8 with an envelope identification system shown in the form of numerical indicia imprinted on the removable receipt portion and the rear panel of the envelope.

A flap section 124 is operatively connected to rear panel 114 by a perforation line 126 which delimits the upper edge 118 of rear panel 114. Perforation line 126 is preferably about 1/16" to ⅛" below the upper edge 116 of front panel 112. The flap section 124, which is approximately ⅞" wide, defines a receipt which may be removed from the envelope by tearing along perforation line 126, and retained by the sender for tracking purposes. As shown in FIG. 10, corresponding numerical indicia **128*a* and 128*b* is imprinted on flap section 124 and on the exterior surface of rear panel 114**, respectively, to identify the envelope. As noted hereinabove, the indicia may also be in the form of graphics, holographic images, or bar codes.

Figure 11:
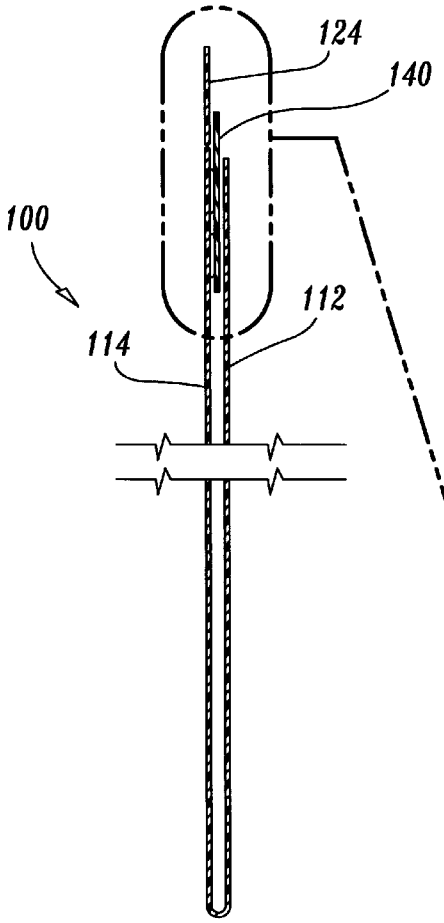
FIG. 11 is a cross-sectional view of the tamper resistant envelope of the subject invention taken along line 11—11 of FIG. 9.

Referring to FIG. 8 in conjunction with FIG. 11, envelope 100 includes two adhesive seals 130 and 132 which are positioned in spaced apart relationship on the interior surface of rear panel 114 to contact and sealingly adhere to the interior surface of the front panel 112 when envelope 100 is closed. As in the previous embodiment, one of the adhesive seals is formed of a material having adherent properties which are resistant to release at temperatures substantially below room temperature, and the other adhesive seal is formed of a material having adherent properties which are not particularly resistant to such low temperatures. Preferably, adhesive seal 130 is resistant to low temperatures and adhesive seal 132 does not have such temperature resistant characteristics. Thus, one seal is resistant to release within a first temperature range and the other seal is resistant to release within a second temperature range which is different from the first temperature range.

In a preferred embodiment of the subject invention, adhesive seals 130 and 132 are both approximately ⅜" wide and extends across the entire width of the interior surface of rear panel 114 from one side edge to the other. The centerline of seal 130 is preferably about ¼" below the upper edge 116 of front panel 112, and the centerline of seal 132 is preferably about ¾" below the upper edge 116 of front panel 112.

Figure 9:
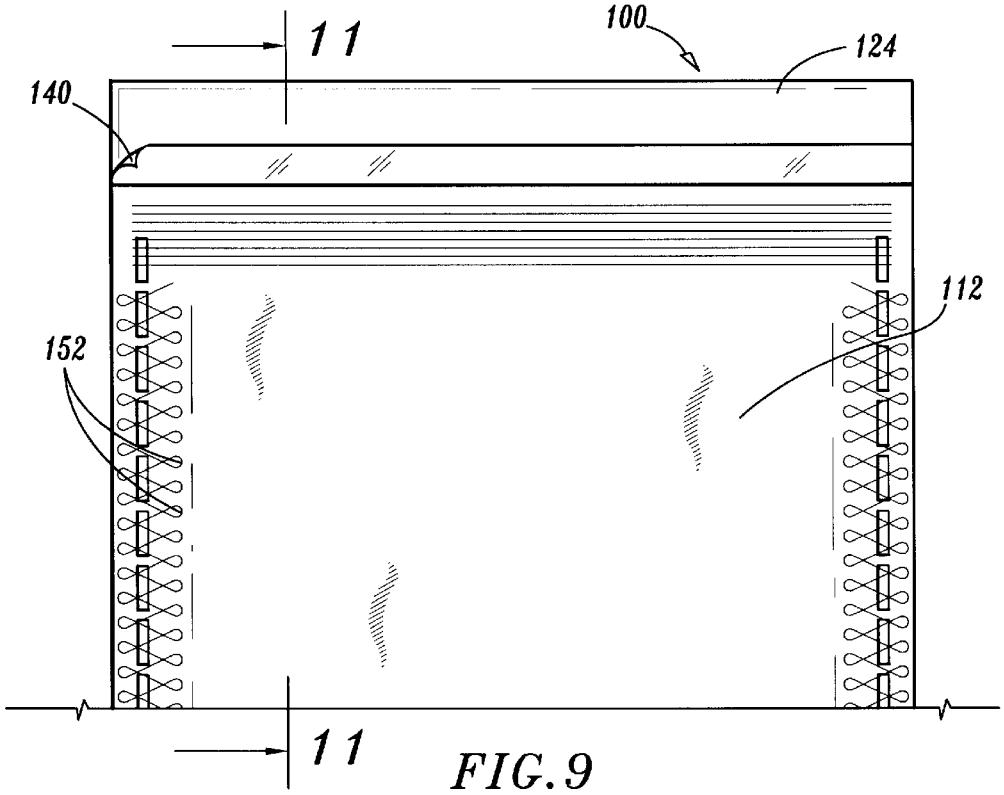
FIG. 9 is a front elevational view of the tamper-resistant envelope illustrated in FIG. 8 with the release liner strip positioned between the upper edges of the front and rear panels of the envelope.
Figure 12:
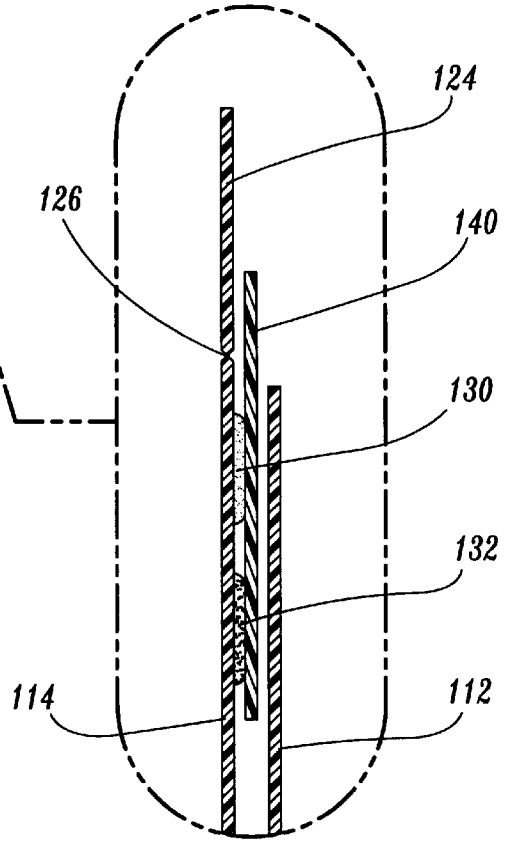
FIG. 12 is an enlarged localized view of the upper region of the tamper-resistant envelope illustrated in FIG. 8 with the release liner strip covering the first and second adhesive seals to prevent their contact with the front panel prior to closing the envelope.

As best seen in FIGS. 8–9 and 12, security envelope 100 includes a removable protective release liner 140 which is dimensioned and configured to cover adhesive seals 130 and 132 in there entireties to prevent the two adhesive seals from contacting the interior surface of front panel 112. Release liner 140 is preferably about 1½" wide such that is extends beyond the upper limits of adhesive seal 130 and beyond the lower limits of adhesive seal 132, to provide the user with a means for grasping the release liner during removal.

As illustrated in FIGS. 9 and 10, the front and rear panels 112 and 114 of security envelope 100 are imprinted with geometric patterns that become distorted if attempts are made to open the envelope. The geometric patterns include a plurality of spaced apart parallel lines 150 which extend across the upper borders of both panels, and a swirled pattern 152 which is imprinted in the border regions adjacent the side and bottom edges of the front and rear panels. Any distortion of the geometric patterns will indicate to an observer that the envelope has been tampered with, and that its contents may have been compromised.

Figure 13:
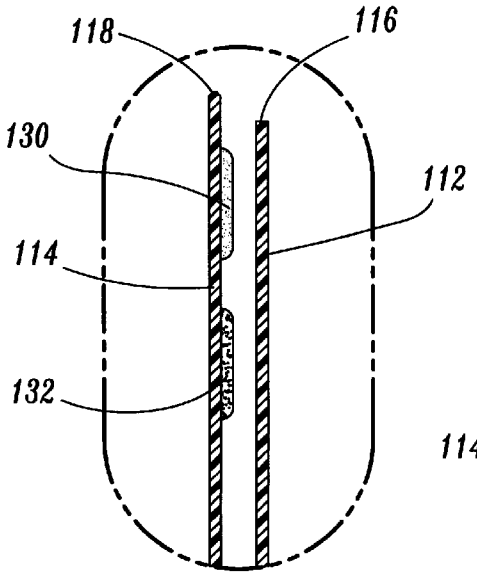
FIG. 13 is a localized view as in FIG. 12 with the release liner strip removed from the envelope to uncover the first and second adhesive seals.
Figure 14:
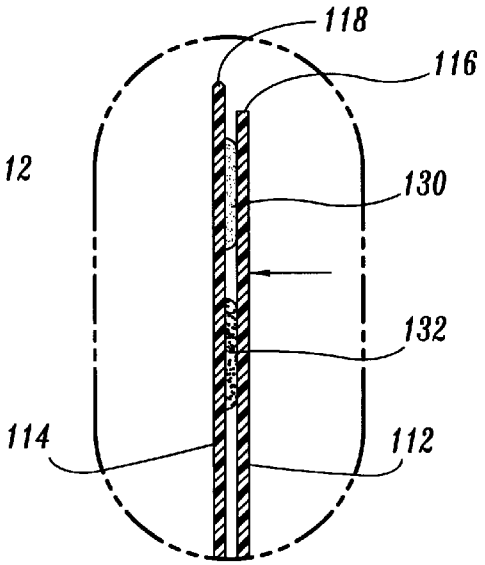
FIG. 14 is a localized view as in FIG. 13 illustrating the envelope in a sealed condition with the first and second adhesive seals secured to the interior surface of the front panel of the envelope.

Referring now in sequential order to FIGS. 11–14, to securely seal envelope 100, release liner strip 140 is removed from the protective position illustrated in FIGS. 11 and 12, and discarded. At such a time, adhesive seals 130 and 132 are both free to contact the exterior surface of front panel 12 and adhesive seal 32 is free to contact the interior surface of front panel 12, as shown in FIG. 13. The flap section 124 may then be torn from the envelope along perforation line 126 and retained by the user for identification purposes. Subsequently, pressure is applied to the seal region to adhere seals 130 and 132 to the interior surface of front panel 112, as illustrated in FIG. 14. Thereupon, envelope 100 cannot be opened by applying a cooling or freezing agent to the sealed region, since adhesive seal 130 is unaffected by such tampering. However, if such attempts are made, and force is applied to the sealed region of the envelope to open seal 132, the parallel lines 50 imprinted adjacent the upper edges of the front and rear panels of the envelope will become distorted, as illustrated for example in FIG. 17, providing evidence of tampering.

Figure 16:
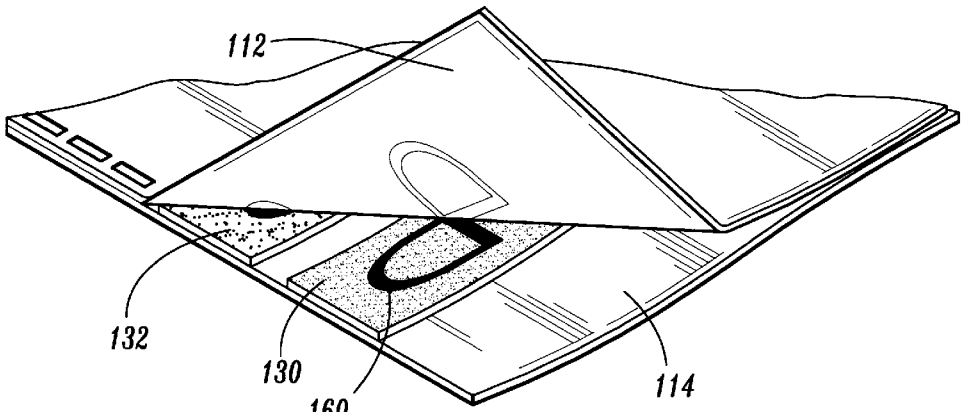
FIG. 16 is a perspective view of a corner portion of an envelope provided with low adhesion indicia when it is opened after being sealed.
Figure 15:
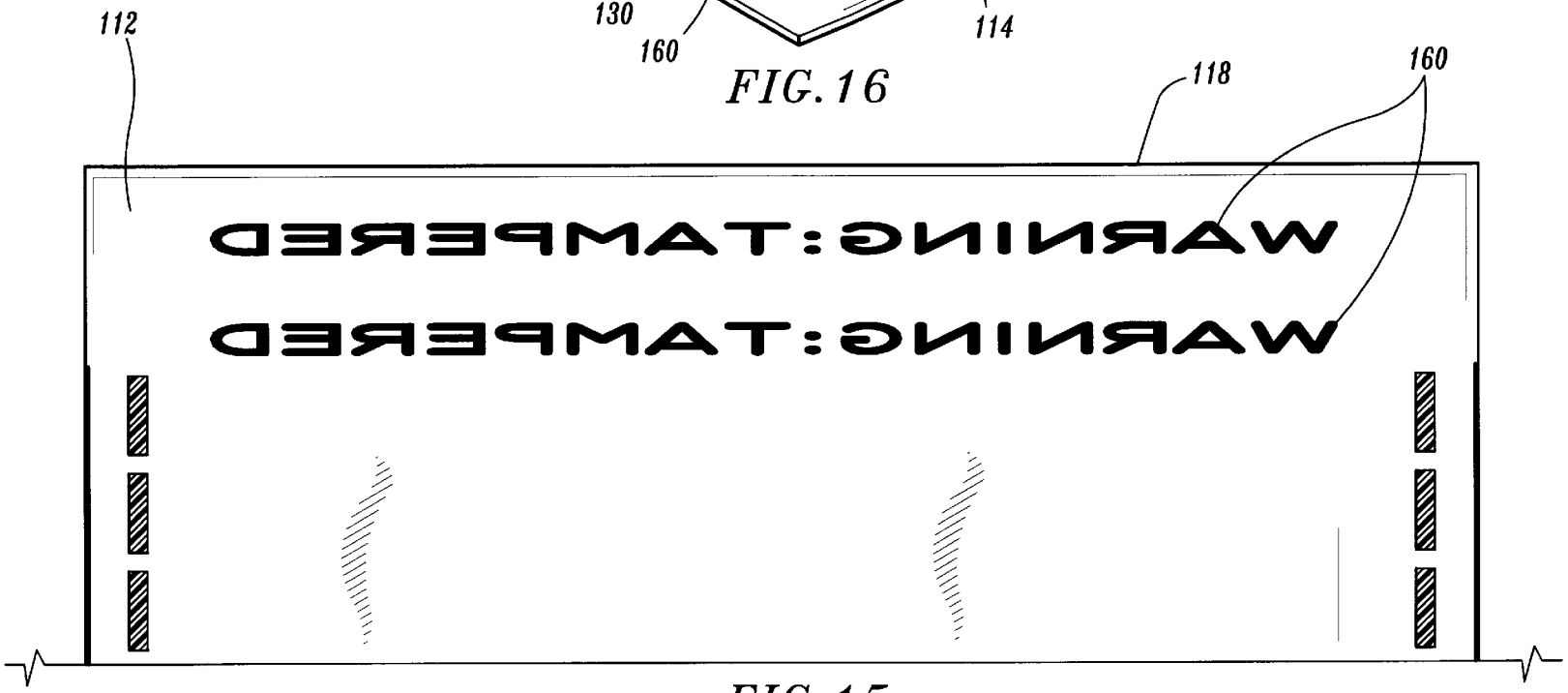
FIG. 15 is a plan view of the upper region of the rear panel of the envelope of FIG. 8 showing tamper evident low adhesion indicia imprinted on the interior surface thereof.
Figure 17:
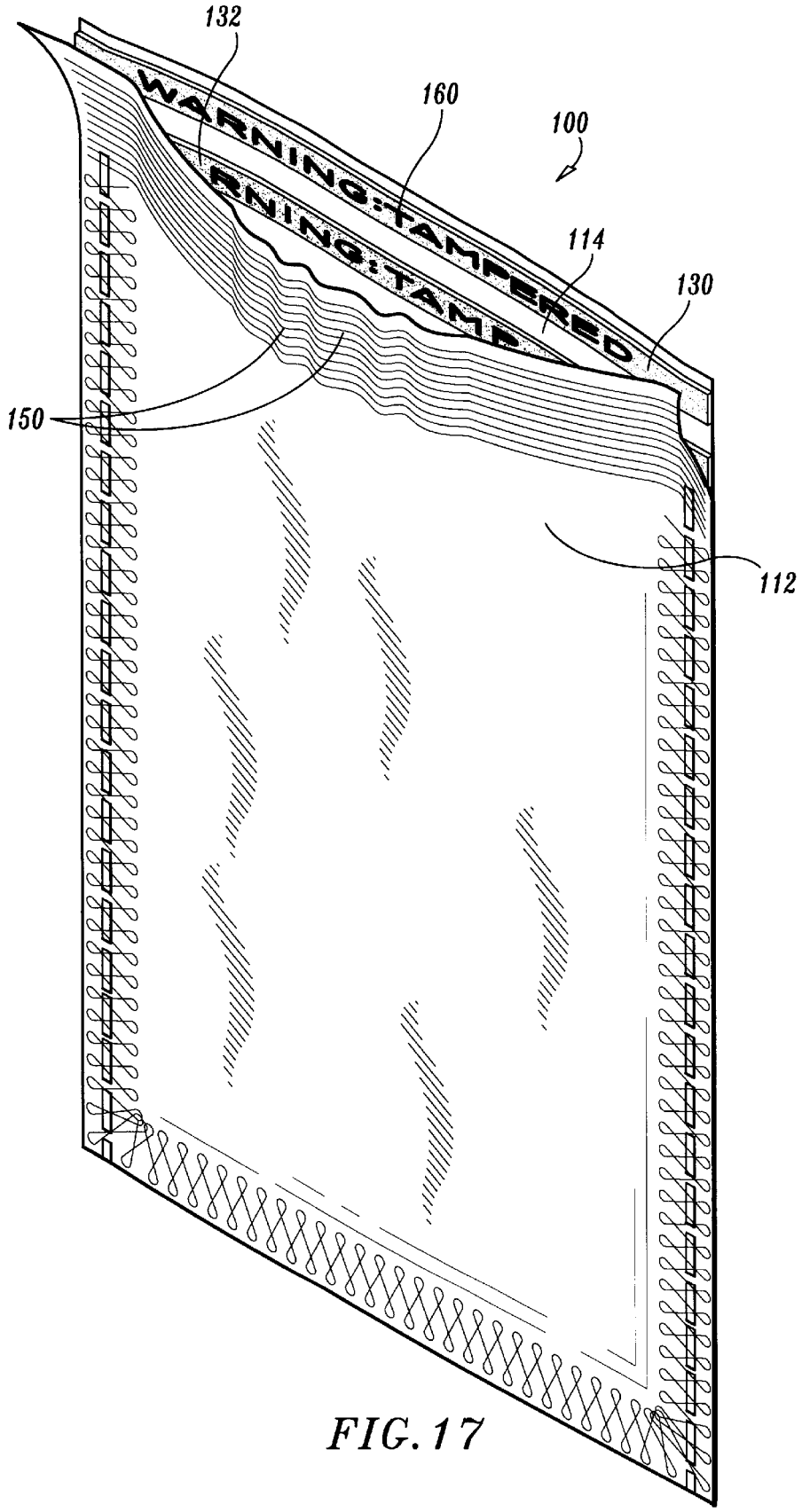
FIG. 17 is a perspective view of an envelope corresponding to that which is illustrated in FIG. 8 which includes the tamper indicative indicia shown in FIGS. 15 and 16 and which illustrates the distortion of the tamper evident markings provided on the front panel of the envelope which occurs upon opening the sealed envelope.

Referring now to FIG. 15, envelope 100 includes another tamper indicative security mechanism which comprises patterns of low adhesion indicia 160 imprinted on the interior surface of the rear panel 114 opposite adhesive seals 130 and 132. Indicia 160 is adapted to adhere to seals 130 and 132 when the envelope is closed and the seals contact the interior surface of front panel 112. As illustrated in FIG. 15, the indicia is imprinted on the interior surface of rear panel 114 in an inverted fashion so that it is easily legible when the envelope is opened. Release liner 140 prevents the indicia from adhering to the seals when the envelope is not employed. However, when the release liner is removed and the envelope is sealed, indicia 160 adheres to the seals. Subsequently, as illustrated in FIGS. 16 and 17, when the envelope is opened, the indicia is visibly apparent on the surface of the seals, indicating to an observer that tampering has occurred.

Although the subject invention has been described with respect to preferred embodiments, it will be readily apparent to those having ordinary skill in the art to which it appertains that changes and modifications may be made thereto without departing from the spirit or scope of the subject invention as defined by the appended claims.

What is claimed is:

1. A tamper-resistant envelope comprising:

first and second panels joined to one another to define opposed side edges, upper edges, and a bottom edge, the envelope having an opening opposite the bottom edge for providing access thereinto;

a first adhesive seal disposed on an interior surface of said first panel opposite an interior surface of said second panel adjacent the opening for sealingly adhering to the interior surface of the second panel at a location spaced from the upper edge of the second panel, said first adhesive seal formed of an adhesive material having adherent properties which are resistant to release at temperatures substantially below room temperature; and a second adhesive seal disposed on said first panel for sealingly adhering to an exterior surface of said second panel at a location spaced from the upper edge of the second panel, said second adhesive seal formed of an adhesive material having temperature related adherent properties which are different from those of the adhesive material from which said first adhesive seal is formed.

2. An envelope as recited in claim 1, wherein the upper edge of said first panel extends beyond the upper edge of said second panel to define a fold-over flap.

3. An envelope as recited in claim 2, wherein said second adhesive seal is positioned on said fold-over flap to adhere to the exterior surface of said second panel when the envelope is closed.

4. An envelope as recited in claim 3, wherein a fold line is provided on said first panel between said first adhesive seal and said second adhesive seal to delimit said fold-over flap.

5. An envelope as recited in claim 3, wherein a removable flap is operatively connected to said fold-over flap to define an envelope receipt.

6. An envelope as recited in claim 5, where a perforation line extends across said first panel to delimit said removable flap and facilitate removal thereof.

7. An envelope as recited in claim 1, further comprising a release liner strip covering said first adhesive seal and said second adhesive seal to prevent the adhesive seals from contacting said second panel prior to closing the envelope.

8. An envelope as recited in claim 1, wherein the envelope is formed from a single piece of plastic material which is folded during a forming process in such a manner so as to form said first and second panels.

9. An envelope as recited in claim 8, wherein said first and second panels are fused to one another along opposed side edges thereof.

10. An envelope as recited in claim 9, wherein said first and second panels are further fused to one another at a plurality of linearly spaced apart locations adjacent the opposed side edges thereof to define opposed skip seals.

11. A tamper-resistant envelope comprising:

first and second panels joined to one another to define opposed side edges and a bottom edge, each of said panels having an upper edge which together define an opening opposite the bottom edge for providing access into the envelope, the upper edge of said first panel extending beyond the upper edge of said second panel to define a fold-over flap;

a first adhesive seal disposed on an interior surface of said fold-over flap of said first panel for sealingly adhering to an exterior surface of said second panel, said first adhesive seal formed of an adhesive material having adherent properties which are resistant to release at temperatures substantially below room temperature; and a second adhesive seal disposed directly on said interior surface of said first panel spaced from said first adhesive seal for sealingly adhering to an interior surface of said second panel at a location spaced from said first adhesive seal, said second adhesive seal formed of an adhesive material having temperature adherent properties which are different from those of the adhesive material from which said first adhesive seal is formed.

12. An envelope as recited in claim 11, wherein a fold line is provided on said first panel between said first adhesive seal and said second adhesive seal to delimit said fold-over flap.

13. An envelope as recited in claim 11, further including a release liner strip covering said first adhesive seal and said second adhesive seal to prevent the adhesive seals from contacting said second panel prior to closing the envelope.

14. An envelope as recited in claim 11, wherein a removable flap is operatively connected to said fold-over flap to define an envelope receipt.

15. An envelope as recited in claim 14, wherein a perforated line extends across said first panel to delimit said removable flap and facilitate removal thereof, said perforation line defining the upper edge of said first panel.

16. An envelope as recited in claim 11, wherein the envelope is formed from a single piece of plastic material which is folded during a forming process in such a manner so as to form said first panel and said second panel.

17. An envelope as recited in claim 16, wherein said first and second panels are fused to one another along the opposed side edges thereof.

18. An envelope as recited in claim 17, wherein said first and second panels are fused to one another at a plurality of linearly spaced apart locations adjacent the opposed side edges thereof to define opposed skip seals.

19. An envelope as recited in claim 11, wherein geometric patterns are imprinted on exterior surfaces of the first and second panels about the peripheries thereof, said geometric patterns being adapted and configured to become distorted if envelope tampering occurs.

20. A tamper-resistant envelope comprising:

first and second panels joined to one another to define opposed side edges and a bottom edge, each of said panels having an upper edge defining an opening opposite the bottom edge for providing access thereinto;

a first adhesive seal disposed directly on an interior surface of said first panel adjacent the opening for sealingly adhering to an interior surface of the second panel, said first adhesive seal formed of an adhesive material having adherent properties which are resistant to release at temperatures within a first temperature range; and a second adhesive seal spaced from said first adhesive seal disposed on the interior of said first panel for sealingly adhering to the exterior of said second panel, said second adhesive seal formed of an adhesive material having adherent properties which are resistant to release at temperatures within a second temperature range different from said first temperature range.

21. An envelope as recited in claim 20, wherein said first temperature range extends from about room temperature to a temperature substantially below room temperature.

22. An envelope as recited in claim 21, wherein said second temperature range extends from about room temperature to a temperature above room temperature.

* * * * *